US006822197B1

(12) United States Patent
Mattfield

(10) Patent No.: US 6,822,197 B1
(45) Date of Patent: Nov. 23, 2004

(54) ELECTRICALLY HEATED PAINT SCRAPER HEATED BY HEATER WITHIN THE BLADE OR BY HEATED AIR

(76) Inventor: Brian L Mattfield, 202 Ovray Ave., Grand Junction, CO (US) 91501

( * ) Notice: Subject to any disclaimer, the term of this patent is extended or adjusted under 35 U.S.C. 154(b) by 0 days.

(21) Appl. No.: 10/115,481

(22) Filed: Apr. 3, 2002

(51) Int. Cl.[7] ..... H05B 3/00

(52) U.S. Cl. ..... 219/228; 15/236.01; 392/384; 219/541

(58) Field of Search ..... 219/228, 227, 219/229, 541; 15/236.01, 236.02; 30/140; 392/384

(56) References Cited

U.S. PATENT DOCUMENTS 1,905,364 A * 4/1933 Brindley ..... 219/227
2,101,913 A * 12/1937 Meyer ..... 219/229
2,304,559 A * 12/1942 Engesser ..... 219/228
2,511,161 A * 6/1950 Hammond ..... 30/140
2,544,326 A * 3/1951 Jones ..... 219/228
2,719,905 A * 10/1955 Lootens ..... 30/140
2,772,339 A * 11/1956 Bennett et al. ..... 219/227
2,785,267 A * 3/1957 Wickersham et al. ..... 219/228
3,299,838 A * 1/1967 Thietje ..... 219/227
3,325,627 A * 6/1967 Adler ..... 219/228
3,526,750 A * 9/1970 Siegal ..... 219/227
3,623,909 A * 11/1971 Jones ..... 134/5
3,673,383 A * 6/1972 Sofia ..... 219/227
3,742,187 A * 6/1973 Folus ..... 219/240
3,906,186 A * 9/1975 Szolis ..... 219/242
4,048,471 A * 9/1977 Ours ..... 219/228
5,287,593 A * 2/1994 Sprunger ..... 15/401
5,357,646 A * 10/1994 Kim ..... 15/111
5,973,294 A * 10/1999 Schatt et al. ..... 219/228

FOREIGN PATENT DOCUMENTS

DE 66230 * 4/1969
DE 2600135 * 7/1977
FR 564175 * 12/1923

* cited by examiner

*Primary Examiner*—John A Jeffery
(74) *Attorney, Agent, or Firm*—Michael I Kroll

(57) ABSTRACT

A paint scraper is provided, with the blade being heated by electrical heating elements within the blade, or in other embodiments, by heated air being discharge from the handle onto the blade. A variety of different blade designs are described. The scraper consists of a hand held unit into which the blade is plugged. A dial is provided on the unit to set the temperature of the blade.

4 Claims, 15 Drawing Sheets

ELECTRICALLY HEATED PAINT SCRAPER HEATED BY HEATER WITHIN THE BLADE OR BY HEATED AIR

BACKGROUND OF THE INVENTION

1. Field of the Invention

The present invention relates generally to paint scrapers and, more specifically, to a thermo paint scraper that is a hand held tool with a heated scraping blade.

2. Description of the Prior Art

Although the advantage of heating the paint on a surface prior to its removal by scraping is known, there is no current tool that provides both the heating function and the scraping function in a hand held scraping tool with alternate blade types. Such a tool is needed to improve the ability of persons removing paint by scraping.

SUMMARY OF THE PRESENT INVENTION

A primary object of the present invention is to provide a thermo paint scraper that is a hand held tool with a heated blade.

Another object of the present invention is to provide a thermo paint scraper that consists of a combination of a sharp edge blade to scrape the paint and a heating element that heats the blade.

Yet another object of the present invention is to provide a thermo paint scraper with a temperature sensor that maintains the blade at a constant temperature, up to 600 degrees Fahrenheit.

Still yet another object of the present invention is to provide high heat to the blade of the thermo paint scraper for transmission to the paint that is to be removed. This helps in softening the paint whereby the edge of the tool can pass through a plurality of paint layers.

Another object of the present invention is to provide alternate blades to more closely match the surfaces where paint is to be removed.

Still yet another object of the present invention is to provide a replaceable scraper assembly that is held in place by a combination of the bay receptacles on the main unit which accept the metal prongs of the assembly, with a heat insulator material isolating the main unit from the scraper assembly.

Another object of the present invention is to provide a paint scraper with a blade heated by heated air discharged from the tool body onto the blade.

Additional objects of the present invention will appear as the description proceeds.

The present invention overcomes the shortcomings of the prior art by providing a thermo paint scraper that is a hand held device that is connected to a power source to electrically heat the scraper assembly scraper member, i.e. the blade. The tool has a sharp edge blade to scrap the paint and a heating element to heat the blade. The thermo paint scraper has a temperature sensor to maintain the blade at a constant temperature, up to 600 degrees Fahrenheit. Alternatable scraper assemblies are provided to more closely match the surfaces where paint is to be removed. The blades are shaped to match the most common of paint surfaces and also to match the most common of "nook and crannie" surfaces. Each scraper assembly has prongs for insertion into receptacles on the tool body.

In another embodiment, the scraper assembly blade is heated by hot air discharged from the tool body onto the blade.

There is provided in one embodiment, a scraping tool adapted to receive electric power from a power source, comprising: a body having a bay, the bay being in electrical communication with the power source, and a scraper assembly having a scraper member, the scraper member being heat conductive and having an electrically insulated interior and a electrically powered heating element within the interior, the scraper assembly further having a docking member, the docking member being securely and removably received by the body bay, the docking member being in electrical communication with the bay, such that electric power is provided to the heating element, the heat from the heating element being conducted to the scraper member.

In one embodiment, the docking member insulates the bay from heat.

In one embodiment, the scraper member is heated to approximately 600 degrees Fahrenheit.

In one embodiment, the tool further comprises an on-off switch positioned on the body such that electrical power to the docking member is terminated when the switch is in the off position.

In one embodiment, the tool further comprises a temperature regulator positioned on the body for regulating the temperature of the scraper member.

In one embodiment, the temperature regulator includes an off position such that electrical power to the docking member is terminated when the regulator is in the off position.

In one embodiment, the docking member has a first prong and a second prong and the bay has a first receptacle and a second receptacle, the first prong mating with the first receptacle, the second prong mating with the second receptacle.

In one embodiment, the scraper member has a straight blade, the blade being substantially perpendicular to the body longitudinal axis when the blade is in a horizontal orientation.

In one embodiment, the tool further comprises alternatable scraper assemblies, each having a different scraper member shape.

There is provided in one embodiment, a scraping tool adapted to receive electric power from a power source, comprising: a body having a bay and a tube, the bay having a first receptacle and a second receptacle, the tube having an open first end proximate the bay; a heating element positioned within the tube, the heating element being in electric communication with the electric power source; a fan, in electric communication with the power source, the fan being positioned within the tube to blow air such that the air encounters the heating element and is discharged from the tube first end; and a scraper assembly having a heat-conductive scraper member and a docking member, the docking member having a first prong for mating with the bay first receptacle, a second prong for mating with the bay second receptacle, and at least one air passage, the scraper member being positioned with respect to the tube first end such that the discharged air passes through the docking member and strikes the scraper member, heating the scraper member.

In one embodiment, the tool further comprises a diffusing member in the docking member at least one air passage for diffusing the discharged air.

In one embodiment, the number of docking member air passages is at least two and each is positioned to redirect a portion of the fanned air from the tube first opening onto the scraper member.

In one embodiment, the number of docking member air passages is one and is generally centered on the docking member.

In one embodiment, the docking member insulates the bay from heat.

In one embodiment, the scraper member is heated to approximately 600 degrees Fahrenheit.

In one embodiment, the tool further comprises an on-off switch positioned on the body such that electrical power to the fan and heating element is terminated when the switch is in the off position.

In one embodiment, the tool further comprises a temperature regulator positioned on the body for regulating the temperature of the scraper member.

In one embodiment, the temperature regulator includes an off position such that electrical power to the fan and the heating element is terminated when the regulator is in the off position.

In one embodiment, the docking member has a first prong and a second prong and the bay has a first receptacle and a second receptacle, the first prong mating with the first receptacle, the second prong mating with the second receptacle.

In one embodiment, the scraper member has a straight blade, the blade being substantially perpendicular to the body longitudinal axis when the blade is in a horizontal orientation.

In one embodiment, the tool further comprises alternatable scraper assemblies, each having a different scraper member shape.

There is provided in one embodiment, a scraping tool adapted to receive electric power from a power source, comprising: a body having a bay, the bay being in electrical communication with the power source; a scraper assembly having a scraper member and a docking member, the docking member being securely and removably received by the body bay; and heating means for electrically heating the scraper member.

In one embodiment, the scraper member is heated to approximately 600 degrees Fahrenheit.

In one embodiment, the tool further comprises switch means for turning the heating means on and off.

In one embodiment, the tool further comprises temperature regulating means for regulating the temperature of the scraper member.

There is provided in one embodiment, a scraping tool adapted to receive electric power from a power source, comprising: a body having a bay, the bay being in electrical communication with the power source, the bay having a first and second receptacle; a scraper assembly having a scraper member, the scraper member having a straight blade, the blade being substantially perpendicular to the body longitudinal axis when the blade is in a horizontal orientation. the scraper member being heat conductive and having an electrically insulated interior and a electrically powered heating element within the interior, the scraper assembly further having a docking member, the docking member having a first prong and a second prong, the first prong being securely and removably received by the body bay first receptacle, the second prong being securely and removably received by the body bay second receptacle, the docking member being in electrical communication with the bay, such that electric power is provided to the heating element, the heat from the heating element being conducted to the scraper member, the docking member insulating the bay from the heat; a temperature regulator positioned on the body for regulating the temperature of the scraper member, the temperature regulator having an off position such that electrical power to the docking member is terminated when the regulator is in the off position; and at least one additional scraper assembly, the at least one additional scraper assembly being alternatable with the scraper assembly, each of the at least one additional scraper assemblies having a different scraper member shape.

There is provided in one embodiment, a scraping tool adapted to receive electric power from a power source, comprising: a body having a bay and a tube, the bay having a first receptacle and a second receptacle, the tube having an open first end proximate the bay; a heating element positioned within the tube, the heating element being in electric communication with the electric power source; a fan, in electric communication with the power source, the fan being positioned within the tube to blow air such that the air encounters the heating element and is discharged from the tube first end; a scraper assembly having a heat-conductive scraper member and a docking member, the docking member having a first prong for mating with the bay first receptacle, a second prong for mating with the bay second receptacle, and an air passage, the air passage being generally centered on the docking member, the air passage having a diffusing member, the scraper member being positioned with respect to the tube first end such that the discharged air passes through the docking member diffusing member and strikes the scraper member, heating the scraper member, the docking member insulating the bay from heat; a temperature regulator positioned on the body for regulating the temperature of the scraper member, the temperature regulator having an off position such that electrical power to the fan and heating element is terminated when the regulator is in the off position; and at least one additional scraper assembly, the at least one additional scraper assembly being alternatable with the scraper assembly, each of the at least one additional scraper assemblies having a different scraper member shape.

There is provided in one embodiment, a scraping tool adapted to receive electric power from a power source, comprising: a body having a bay and a tube, the bay having a first receptacle and a second receptacle, the tube having an open first end proximate the bay; a heating element positioned within the tube, the heating element being in electric communication with the electric power source; a fan, in electric communication with the power source, the fan being positioned within the tube to blow air such that the air encounters the heating element and is discharged from the tube first end; a scraper assembly having a heat-conductive scraper member and a docking member, the docking member having a first prong for mating with the bay first receptacle, a second prong for mating with the bay second receptacle, and a pair of air passages, each air passage positioned to redirect a portion of the fanned air from the tube first opening onto the scraper member, heating the scraper member, the docking member insulating the bay from heat; a temperature regulator positioned on the body for regulating the temperature of the scraper member, the temperature regulator having an off position such that electrical power to the fan and heating element is terminated when the regulator is in the off position; and at least one additional scraper assembly, the at least one additional scraper assembly being alternatable with the scraper assembly, each of the at least one additional scraper assemblies having a different scraper member shape.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawings in which:

FIG. 1 is an illustrative view of the present invention. Shown is an illustrative view of the thermo paint scraper in use on a painted wall.

FIG. 2 is an illustrative view of the present invention in use. The high heat generated by the blade of the thermo paint scraper is transmitted to the paint that is to be removed. This helps to somewhat soften the paint whereby the edge of the tool can pass through a plurality of paint layers.

FIG. 3 is a partial, sectional view of the present invention in use with a painted surface. The close up view shows the contact point of the scraper blade meeting the substrate surface. The high heat generated by the scraper blade is transmitted to the paint.

FIG. 4 is a perspective view of the present invention. This perspective view of the present invention clearly shows the heat control wheel which allows the operator to set the blade temperature. A heat sensor provides feedback and keeps the temperature constant.

FIG. 5 is a top view of the present invention with some interior components shown. Shown is the general arrangement of the electrical circuitry.

FIG. 6 is a side view of the present invention with some interior components shown. Shown is the general arrangement of the electrical circuitry. The temperature is controlled by a combination of the user set heat control wheel and heat sensor, which acts as a thermostat.

FIG. 7 is a top sectional view of the present invention. Shown is the general arrangement of the electrical circuitry.

FIG. 8 is a perspective view showing alternatable scraper assemblies. Alternatable blades are provided to more closely match the surfaces where paint is to be removed. The blades are shaped to match the most common of paint surfaces and also to match the most common of "nook and crannie" surfaces.

FIG. 9 is a top sectional view with the scraper assembly removed from the bay. The alternatable scraper assembly is held in place by a combination of the bay receptacles on the main unit which accept the metal prongs of the scraper assembly and also by the insulative material surrounding the scraper assembly forming the docking member. This insulative material is made of a sturdy non-conductive metal and is closely sized to match the bay on the main unit.

DESCRIPTION OF THE REFERENCED NUMERALS

Figure 1:
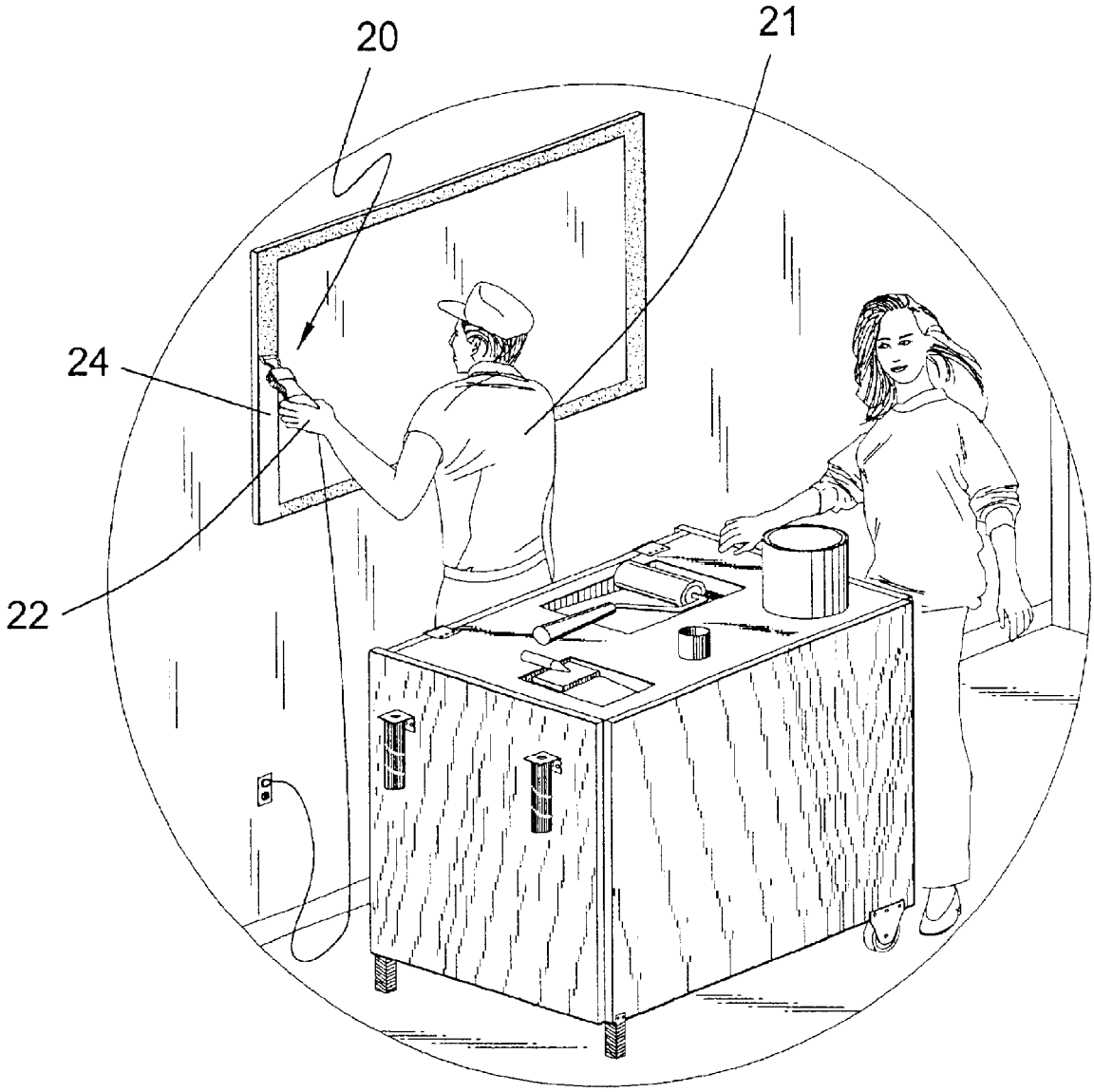

Turning now descriptively to the drawings, in which similar reference characters denote similar elements throughout the several views, the figures illustrate the Thermo Paint Scraper tool of the present invention. With regard to the reference numerals used, the following numbering is used throughout the various drawing figures.

20 Thermo Paint Scraper tool of the present invention
21 user
22 user's hand
23 paint
24 surface
30 body
32 body grip portion
34 power cord
36 wiring
38 heat control wheel
40 heat sensor
42 electrical connectors
44 scraper assembly
46 scraper assembly
48 scraper assembly
50 scraper assembly
52 scraper assembly
54 scraper member
56 scraper member
58 scraper member
59 scraper member protruding portion
60 scraper member
61 scraper member blade
62 scraper member
63 scraper member points
64 docking member
66 docking member
68 docking member
70 docking member
72 docking member
74 bay
76 docking member first prong
78 docking member second prong
80 bay first receptacle
82 bay second receptacle
84 heating element
86 electrical insulator
88 heating element
90 electrical insulator
100 alternate embodiment
102 body
104 body grip portion
106 bay

108 tube
110 insulator
112 docking member
114 diffusing member
116 scraper member
118 first prong
120 second prong
122 first receptacle
124 second receptacle
126 power cord
128 fan
130 heating element
132 wiring
134 heat control wheel
136 heat sensor
138 screen
200 alternate embodiment
202 scraper member
204 docking member
206 ports
208 first prong
210 second prong

DETAILED DESCRIPTION OF THE INVENTION

The following discussion describes in detail the preferred embodiments of the invention. This discussion should not be construed, however, as limiting the invention to those particular embodiments. Practitioners skilled in the art will recognize numerous other embodiments as well. For a definition of the complete scope of the invention, the reader is directed to the appended claims.

Figure 2:
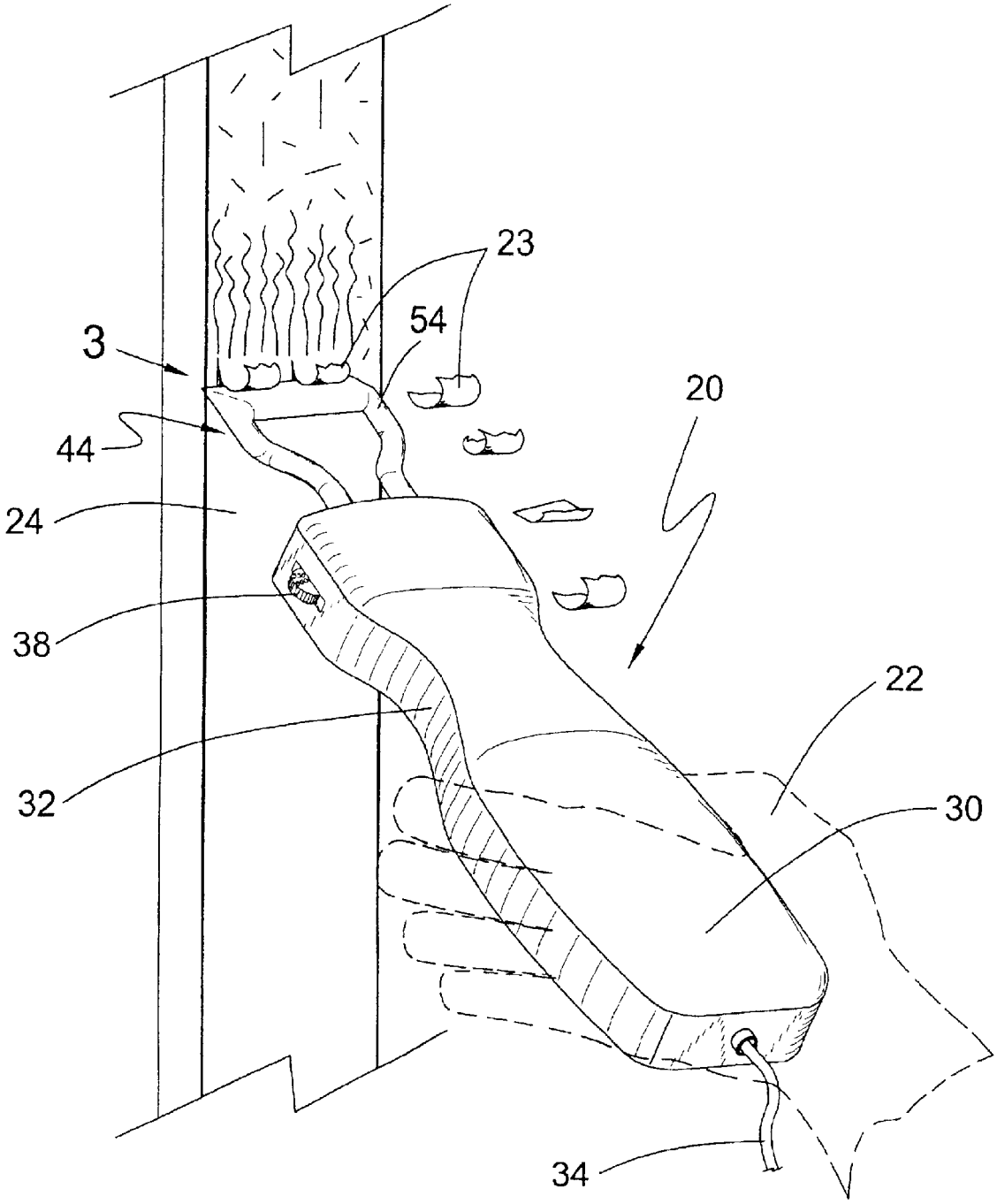
Figure 3:
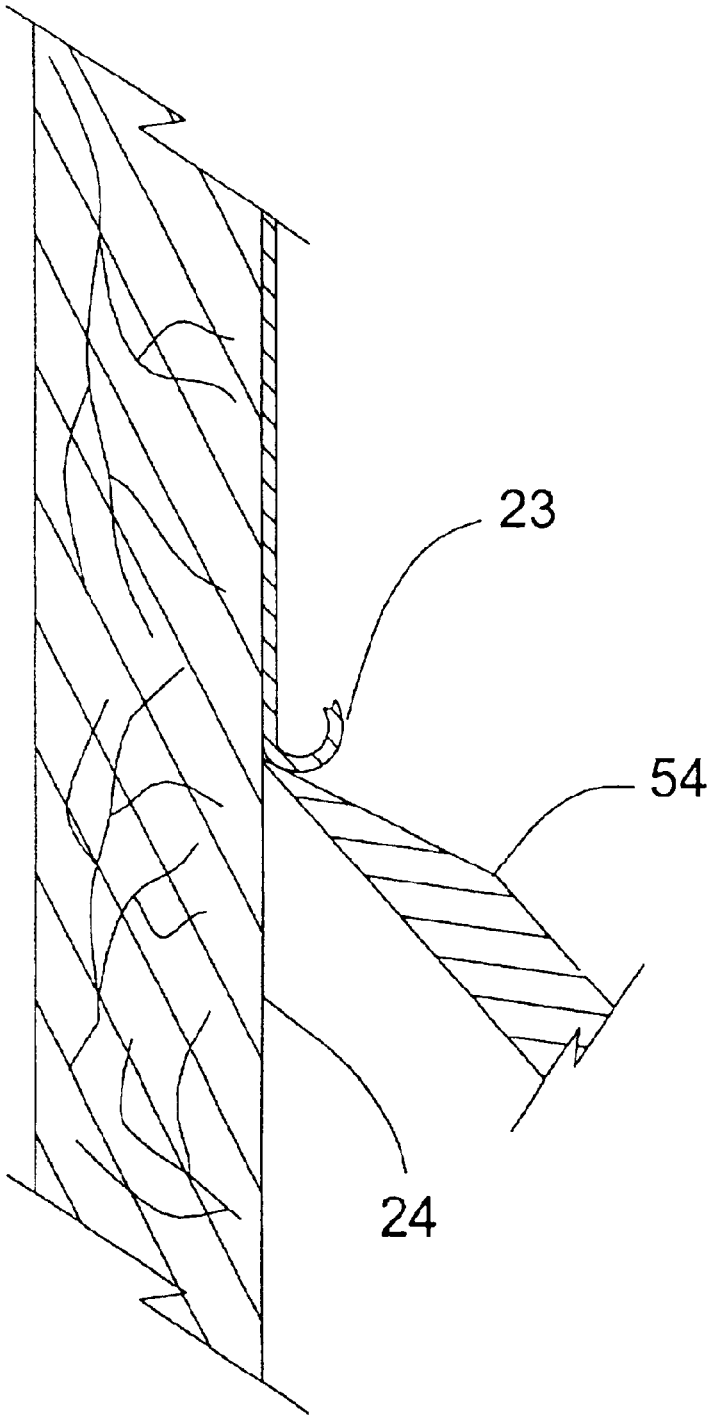
Figure 4:
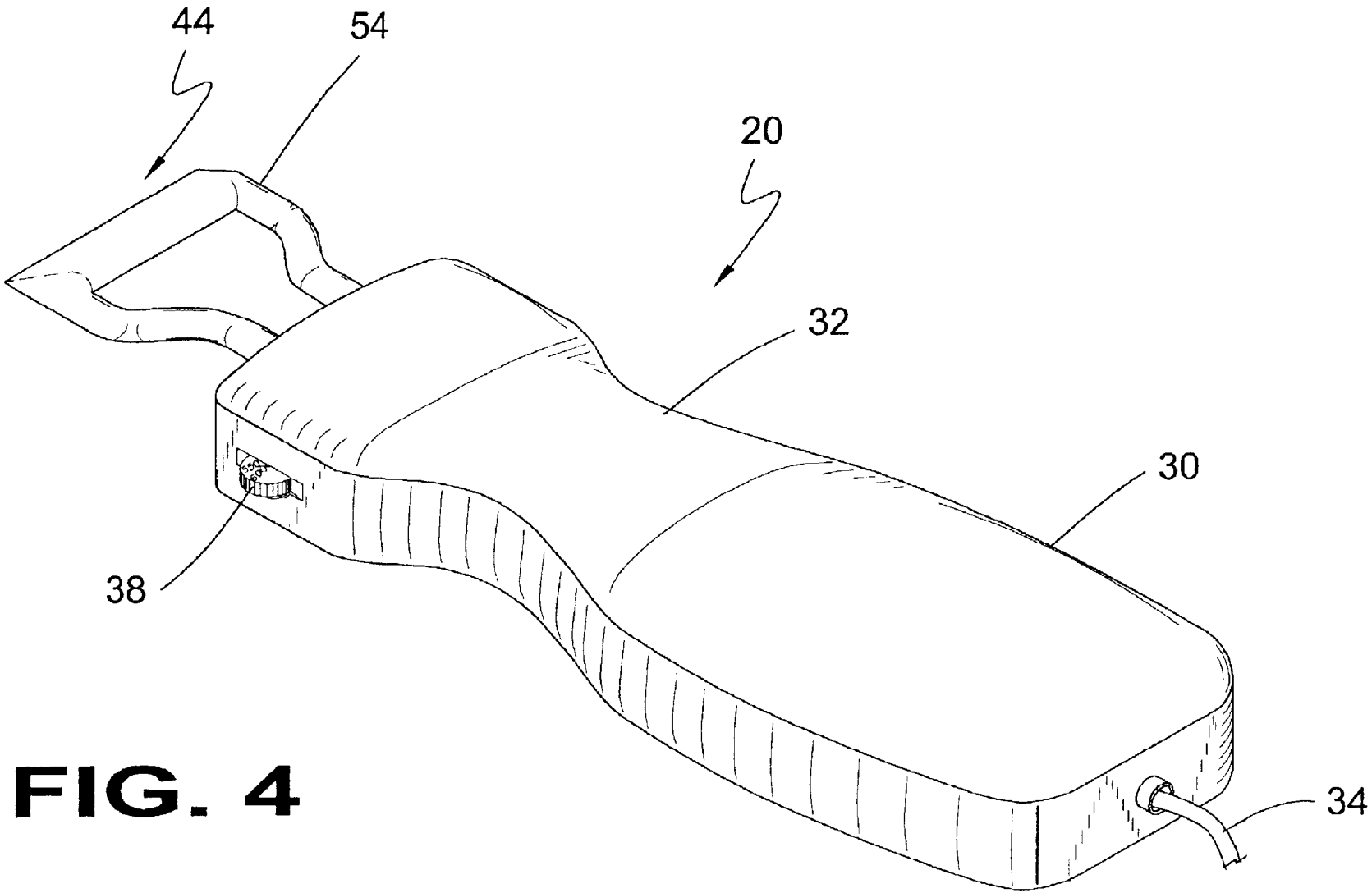

As shown in FIGS. 1–3, the Thermo Paint Scraper tool 20 is grasped by the user 21 in his hand 22, and is used for removing paint 23 from surfaces 24 such as the wall shown.

Figure 5:
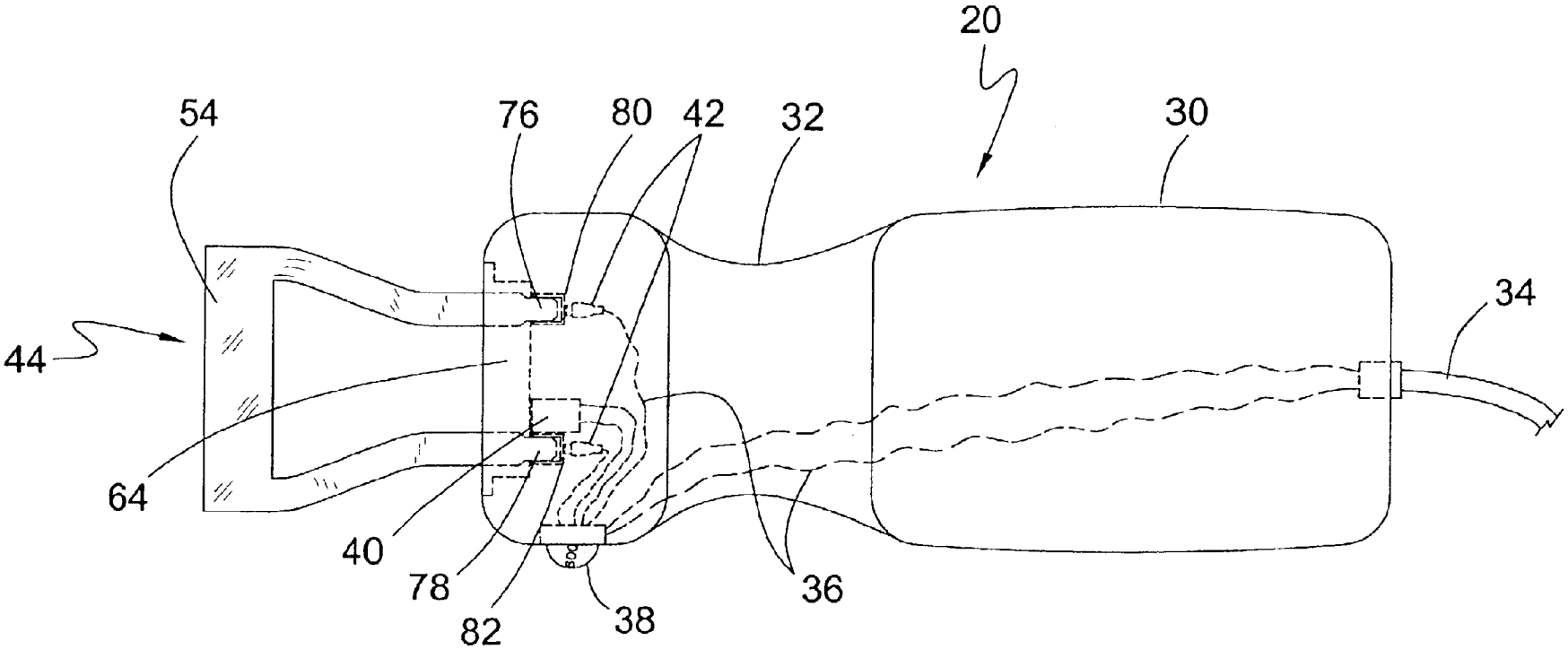
Figure 6:
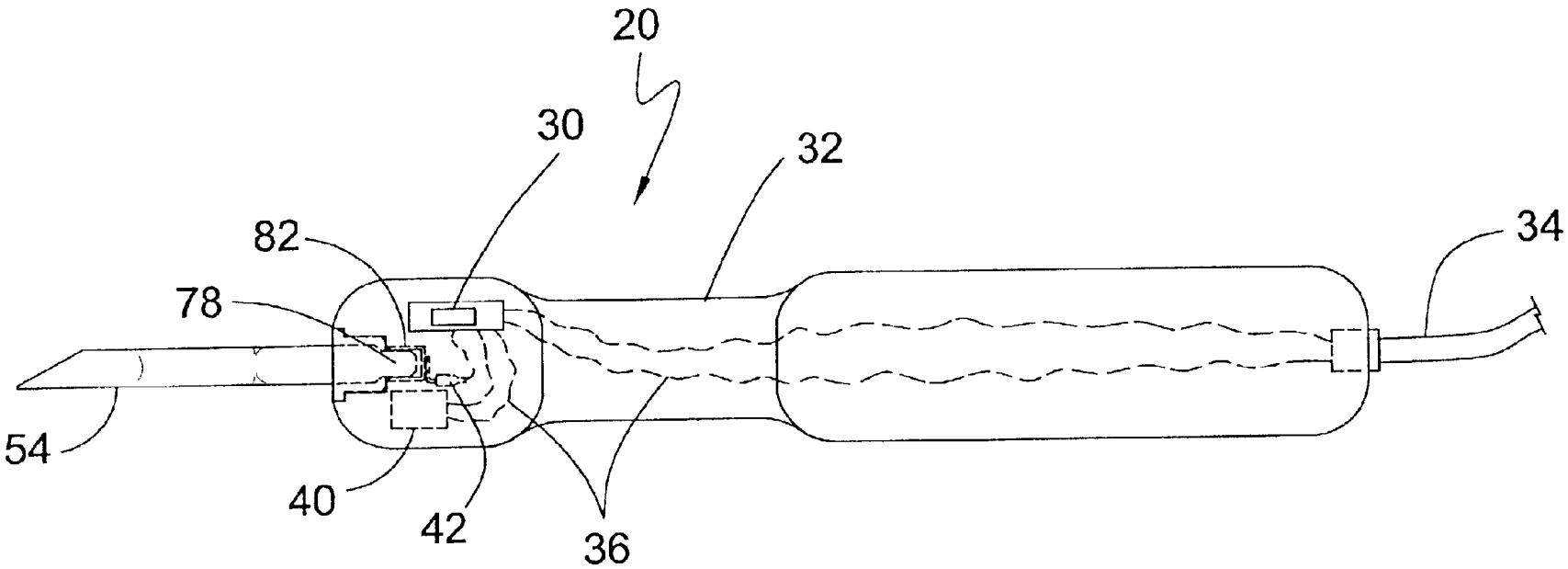
Figure 7:
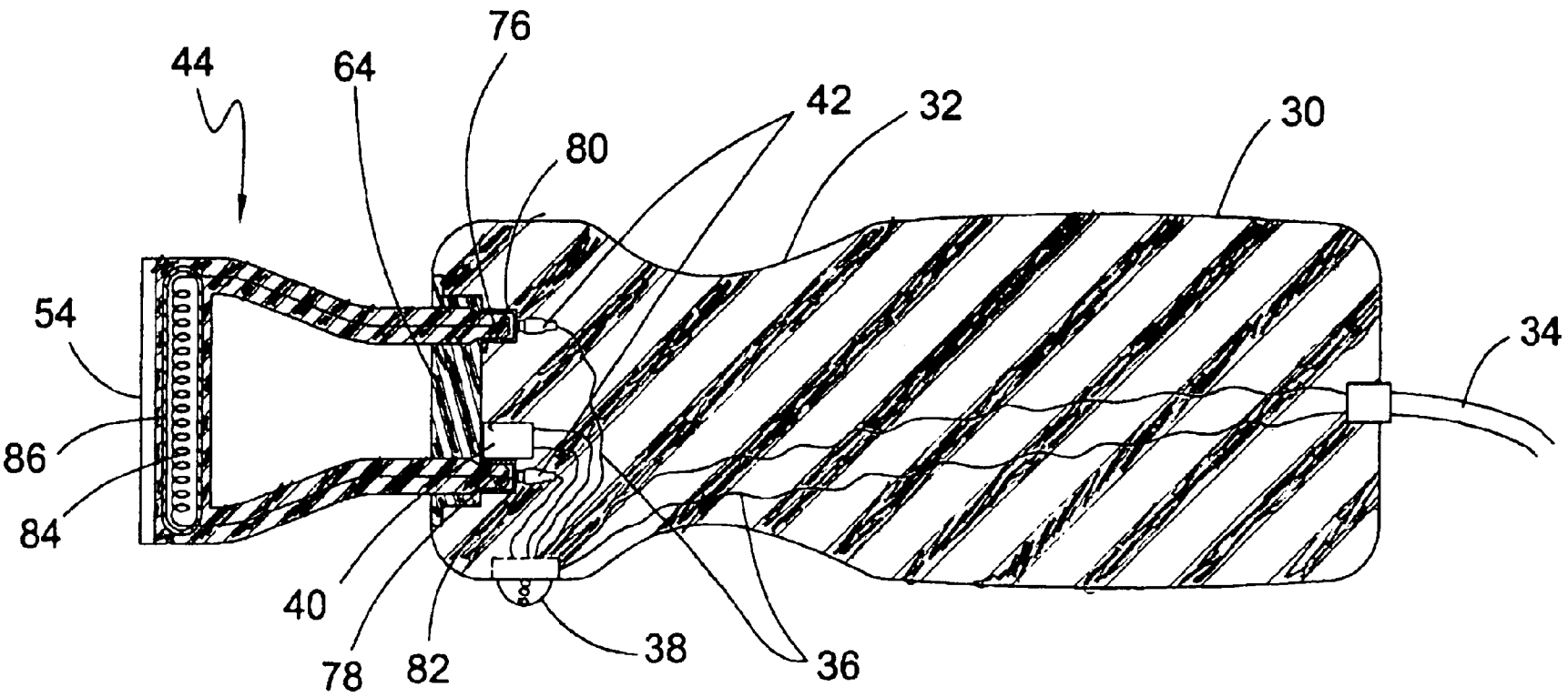

As shown in FIGS. 4–7, the tool 20 has a body 30 with a reduction in circumference to form a body grip portion 32. A power cord 34 extends from the body 30 and conventional wiring 36 is provided for interior electrical communication between the various electrical components. As shown in FIG. 5, these components include a thumb-operated heat control wheel 38 that includes an off position and variable heat setting positions. The heat control wheel 38 responds in thermostatic fashion to signals from the heat sensor 40. Typical electrical connectors 42 are utilized. The body 30 is constructed from various woods, plastics and metals, with a high strength plastic being the optimum material.

Figure 8:
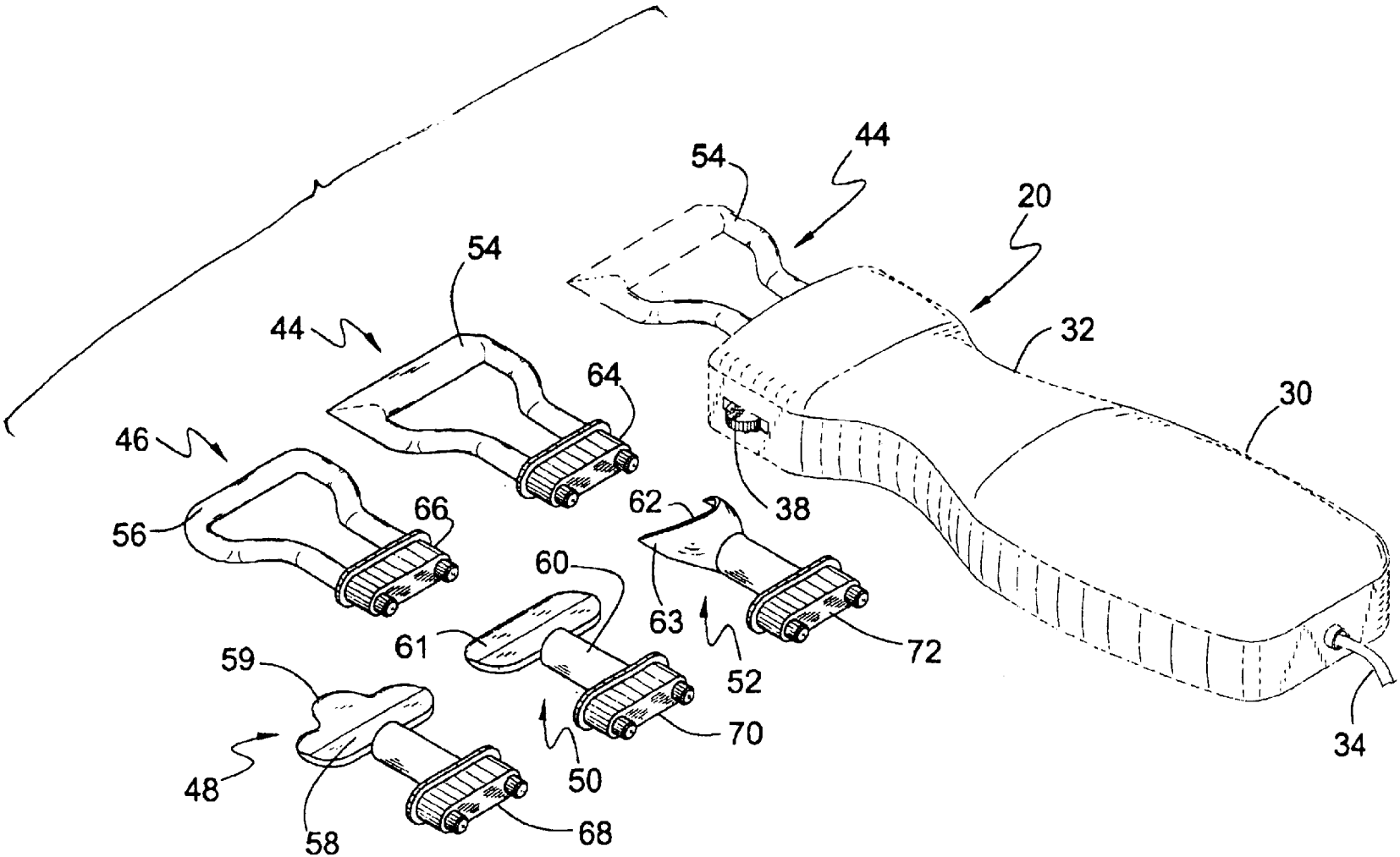

As shown in FIG. 8, five alternate scraper assemblies 44, 46, 48, 50, 52 are provided with each having a scraper member 54, 56, 58, 60, 62 and a docking member 64, 66, 68, 70, 72. The scraping edge on such scraper members 54, 56, 58, 60, 62 is made from a heat-conductive material such as stainless steel, although other metals are used in other embodiments.

Scraper assembly 46 has a scraper member 56 that is rounded. Scraper assembly 48 has a flat and round scraper member portion 59 protruding from the remaining scraper member 58. Scraper assembly 50 has a flat scraper member 60 with rounded edges. Scraper assembly 52 has a scraper member 62 with sharp points 63.

Figure 9:
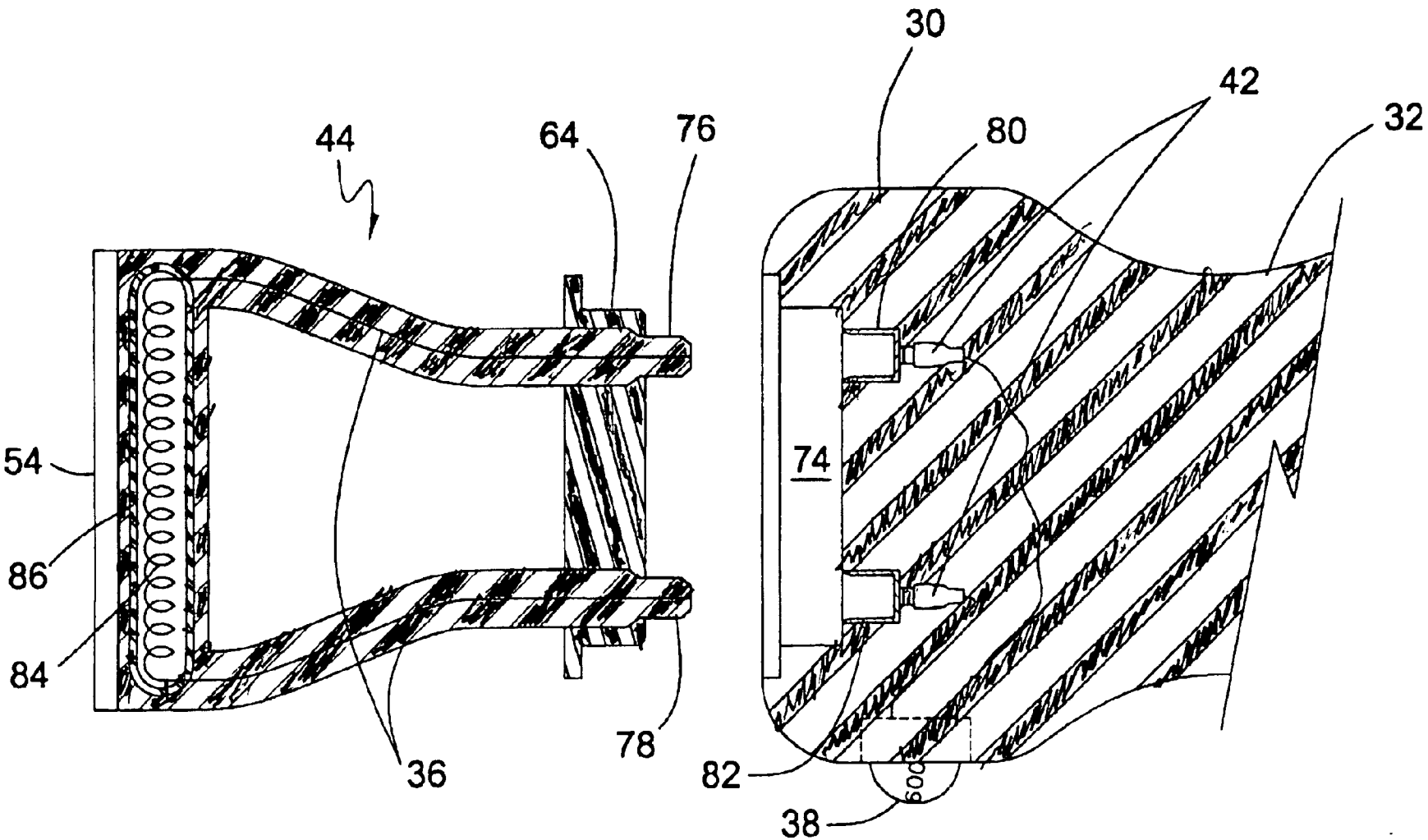
Figure 10:
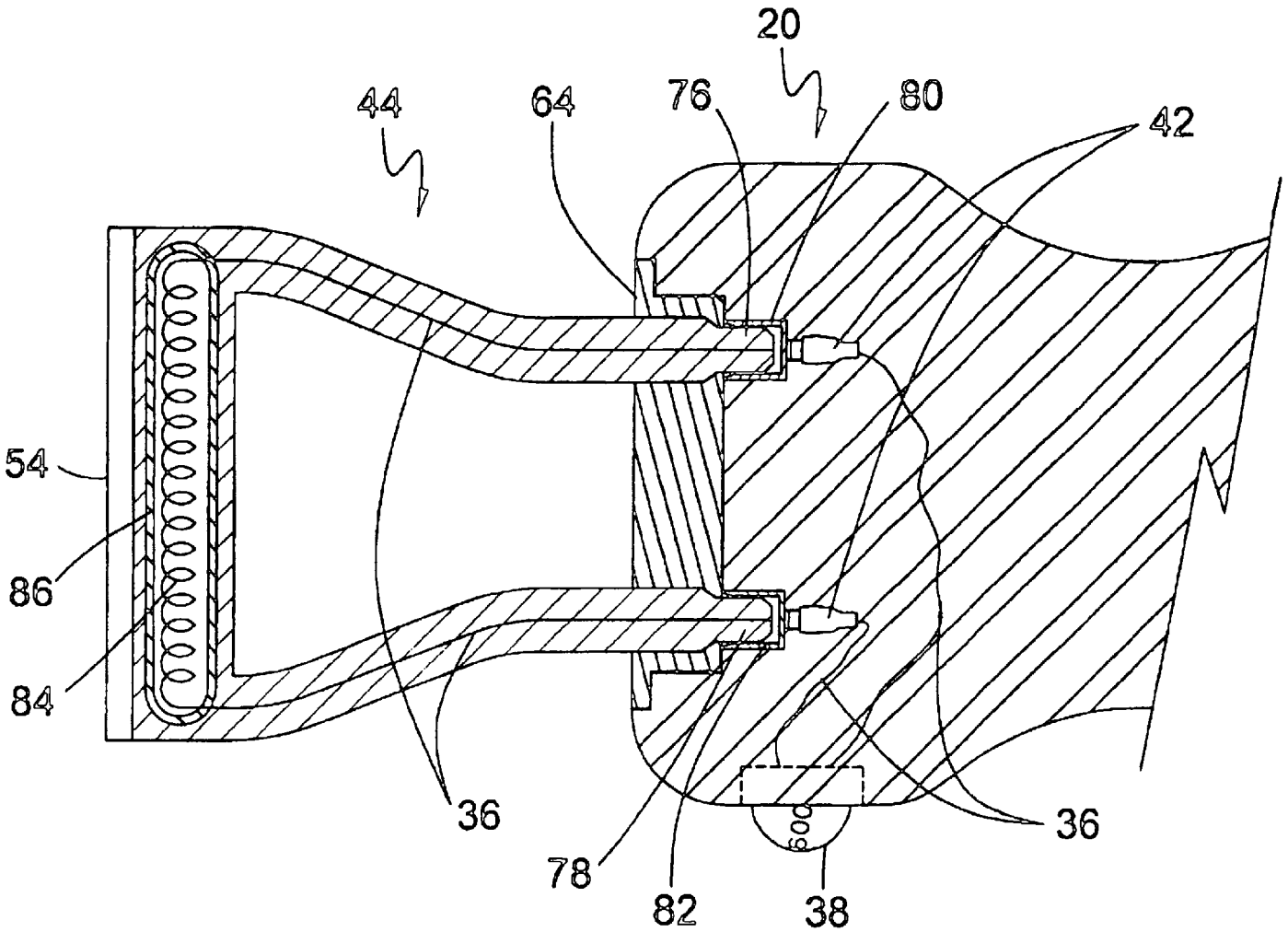
FIG. 10 is a top sectional view with the scraper assembly attached.

As shown in FIGS. 9–10, the docking member 64 is received within a bay 74 with docking member first and second prongs 76,78 being insertable in first and second receptacles 80,82, respectively. When docked the scraper assembly 44 is in electrical communication with the power source.

The docking members 64, 66, 68, 70, 72 are made from a material that is heat conductive or non-heat conductive in different embodiments. Various materials are used, including various plastics and woods.

Figure 11:
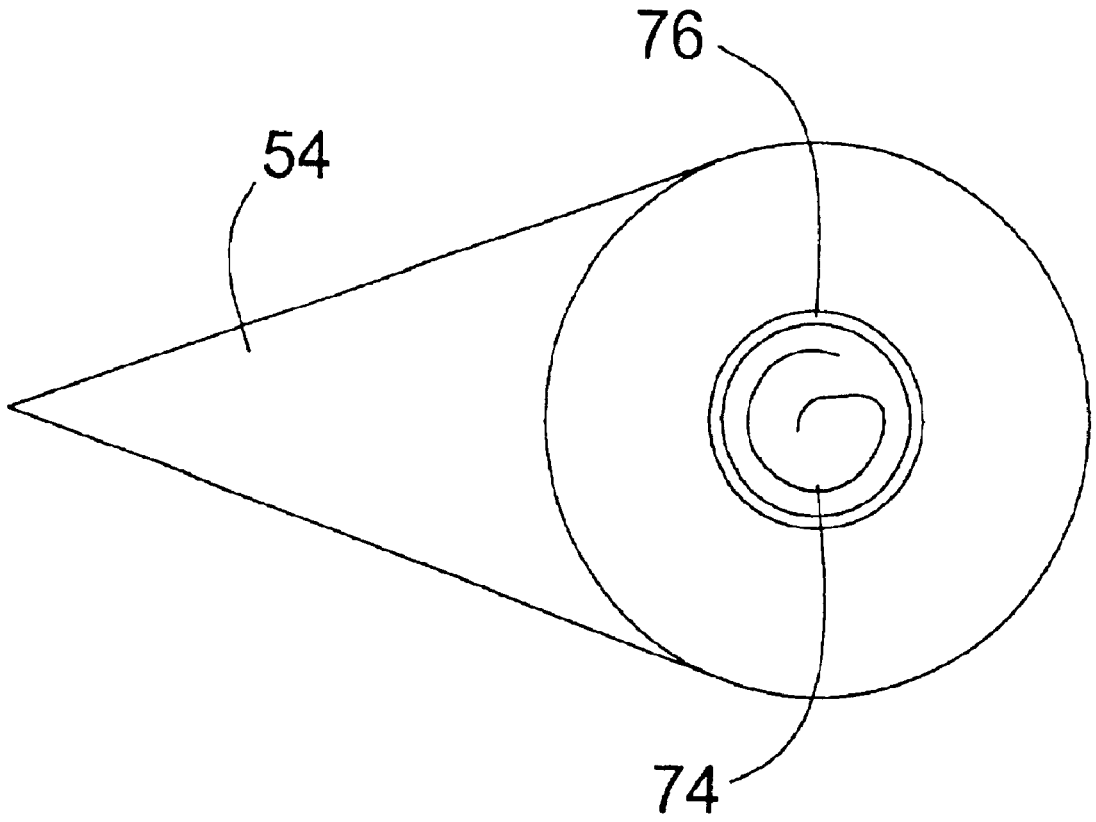
FIG. 11 is a side sectional view of the scraper assembly scraping member, showing the insulated heating element.
Figure 12:
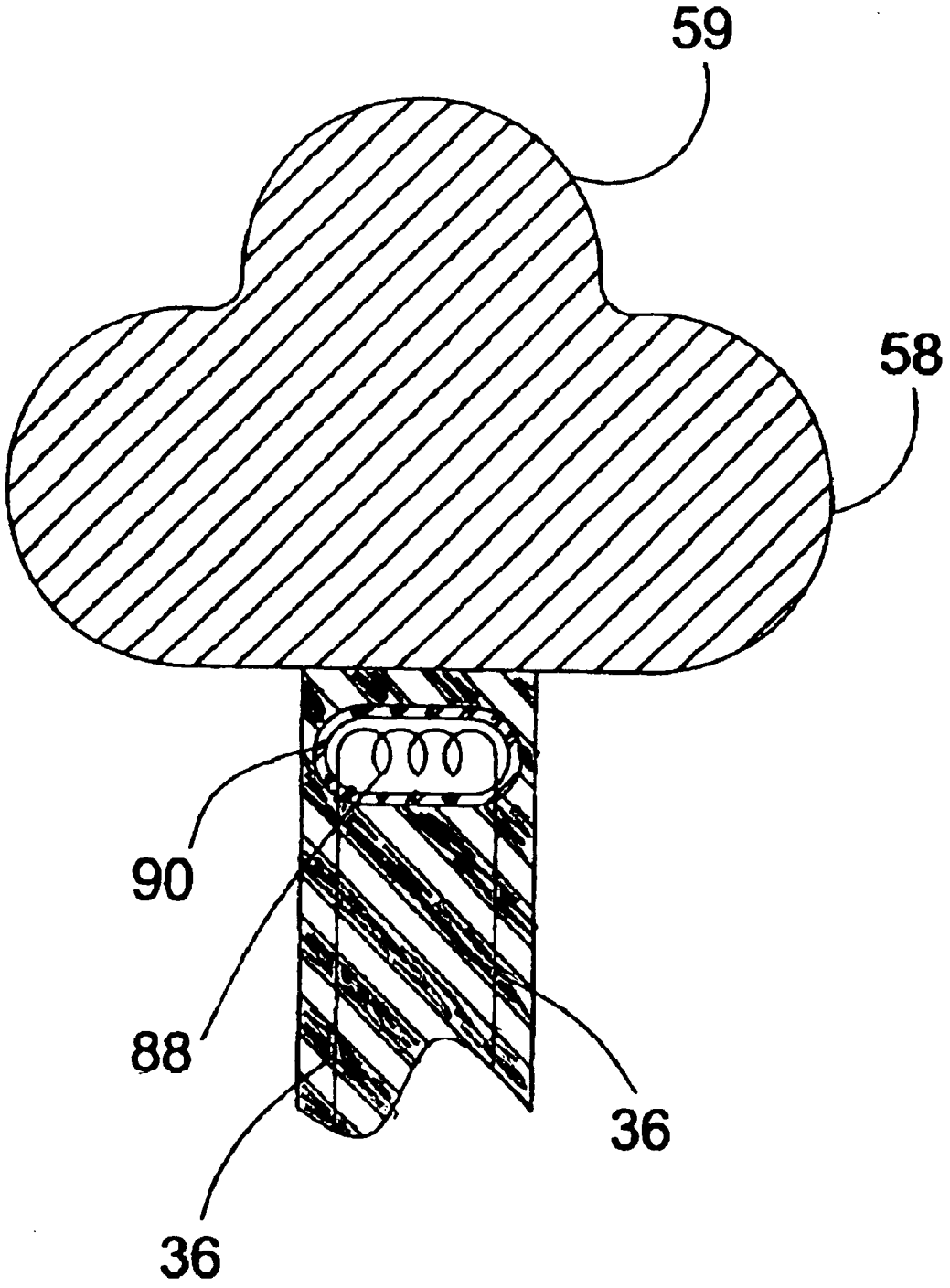
FIG. 12 is a top sectional view of another scraper assembly scraping member, showing the insulated heating element.

One scraper assembly 44 forms a loop from the docking member 64 and has within the scraper member 54 a heating element 84 surrounded by an electrical insulator 86, as shown in FIG. 9 and FIG. 11. The heating element 84 is constructed from various conventional materials, such as nichrome, that are highly resistive and do not oxidize.

The heating element 84 receives electrical power when the docking member 64 is docked in the bay 74. The electrical insulator 86 conducts the heat generated by the heating element 84 to the scraper member 54, while isolating the scraper member 54 from the electrical power. In other embodiments, only the forward edge of the scraper member 54 is heat conductive, the remainder of the scraper member 54 exterior being non-heat conductive. Another scraper assembly 46 is constructed in like fashion as this scraper assembly 44.

In another scraper assembly 48, the scraper member 58 does not loop. The scraper member 58 has a heating element 88 within an electrical insulator 90 that is heat conductive. The heating element receives power when the docking member 68 is docked. The heat from the heating element 88 is transferred to the scraper member 58. In other embodiments, only the scraper member 58 forward edge is heat conductive, the remainder of the scraper member 58 being non-heat conductive. Other scraper assemblies 50,52 are constructed in like fashion as this scraper assembly 48.

The heat sensor 40 senses the heat by its close proximity to the docking member second prong 78. Other conventional heat sensing means, for thermostatic purposes are used in other embodiments such as a sensor located on the scraper member or in proximity to the heating element.

The user 21 begins the scraping operation by plugging in the power cord 34 and grasping the body 30 with his hand 22 about the body grip portion 32. The appropriate scraper assembly 44, 46, 48, 50, 52 is chosen and inserted into the bay 74, establishing electrical communication between the bay 74 and the scraper assembly 44. The user 21 then turns the heat control wheel 38 from the off position to the position indicating the desired heat level. The electric power is then available to the heating element 84 and the scraper member 54 is heated by the powered heating element 84.

During operation the heat sensor 40 signals the thermostatic controls in the heat control wheel 38 to adjust the temperature to conform to the selected heat level. If desired, the user 21 adjusts the heat level by rotating the heat control wheel 38. When finished the user 21 turns the heat control wheel 38 to the off position and the scraper assembly 44 cools.

Figure 13:
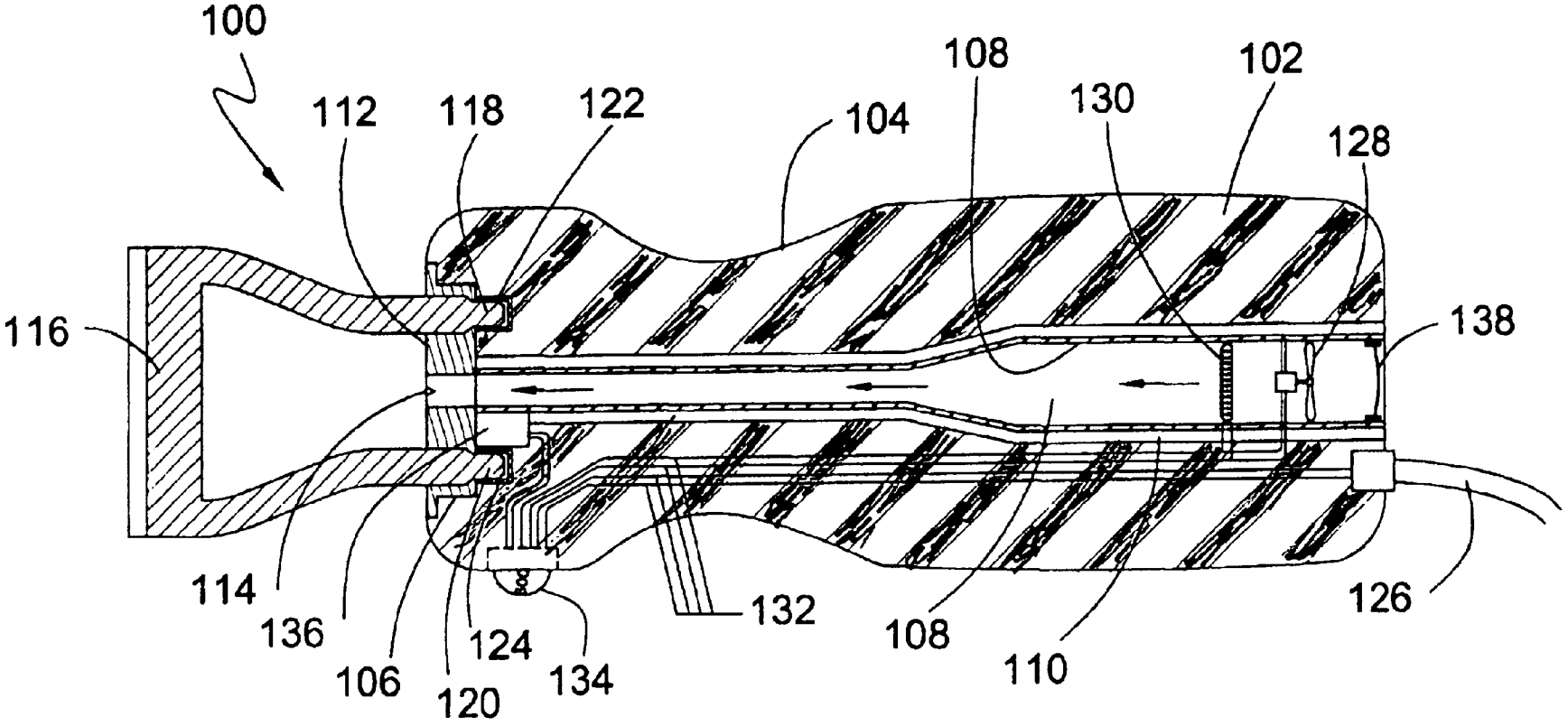
FIG. 13 is a top sectional view of the additional embodiment using heated air to heat the scraper assembly scraper member. The air is discharged through a centrally positioned diffusing member in the docking member air passage.
Figure 14:
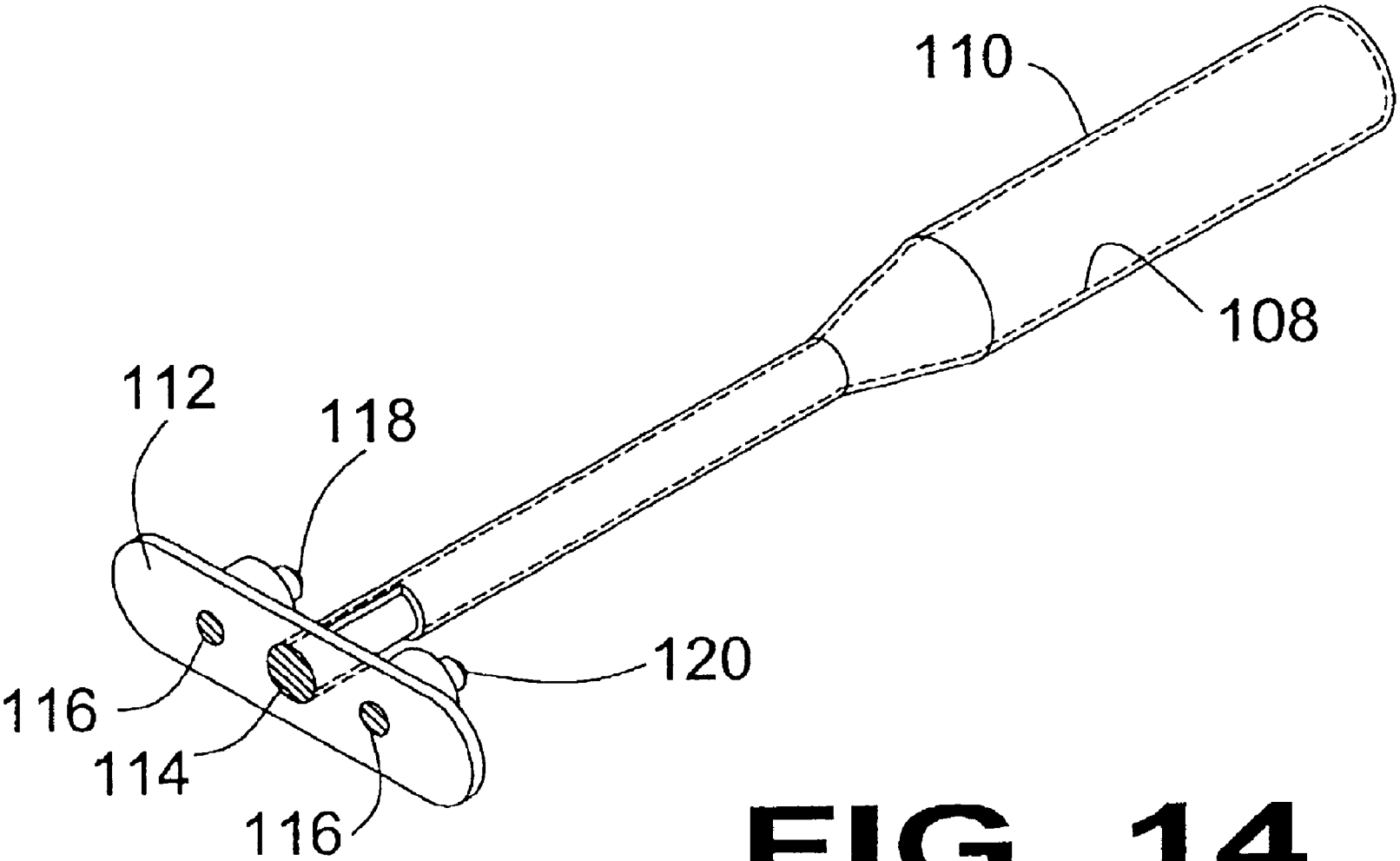
FIG. 14 is an isolated view of the insulated tube and docking member showing the diffusion member.

In another embodiment the tool 100 has a body 102 with a body grip portion 104 and a bay 106, as shown in FIGS. 13–14. The body 102 has a tube 108 running along its length that is surrounded by a heat insulating layer 110. A docking member 112 has a diffusing element 114 positioned to align with the tube 108 when the docking member 112 is docked in the bay 106, as shown in FIG. 14. The scraper member 116 has no interior heating element or wiring, but is otherwise similar to scraper member 54, having, for example, first and second prongs 118,120 for secure and removable docking in first and second bay receptacles 122,124.

Instead of a heating element in the scraper member 116, this tool 100 has an electric power source cord 126 for powering an electric fan 128 and heating element 130 in the tube 108. Conventional wiring 132 is again used to include the heat control wheel 134 and heat sensor 136, as well as, the fan 128 and the heating element 130.

When the fan 128 and heating element 130 are powered in this embodiment 100, the fanned air encounters the heating element 130, is heated and is discharged from the tube 108 through the diffusing element 114 and onto the scraper member 116. A screen 138 filters the air entering the tube 108. The heat sensor 136 senses the heat by virtue of its proximity to the tube 108. Scraper member 56 can be similarly modified to be used on this embodiment 100.

Figure 15:
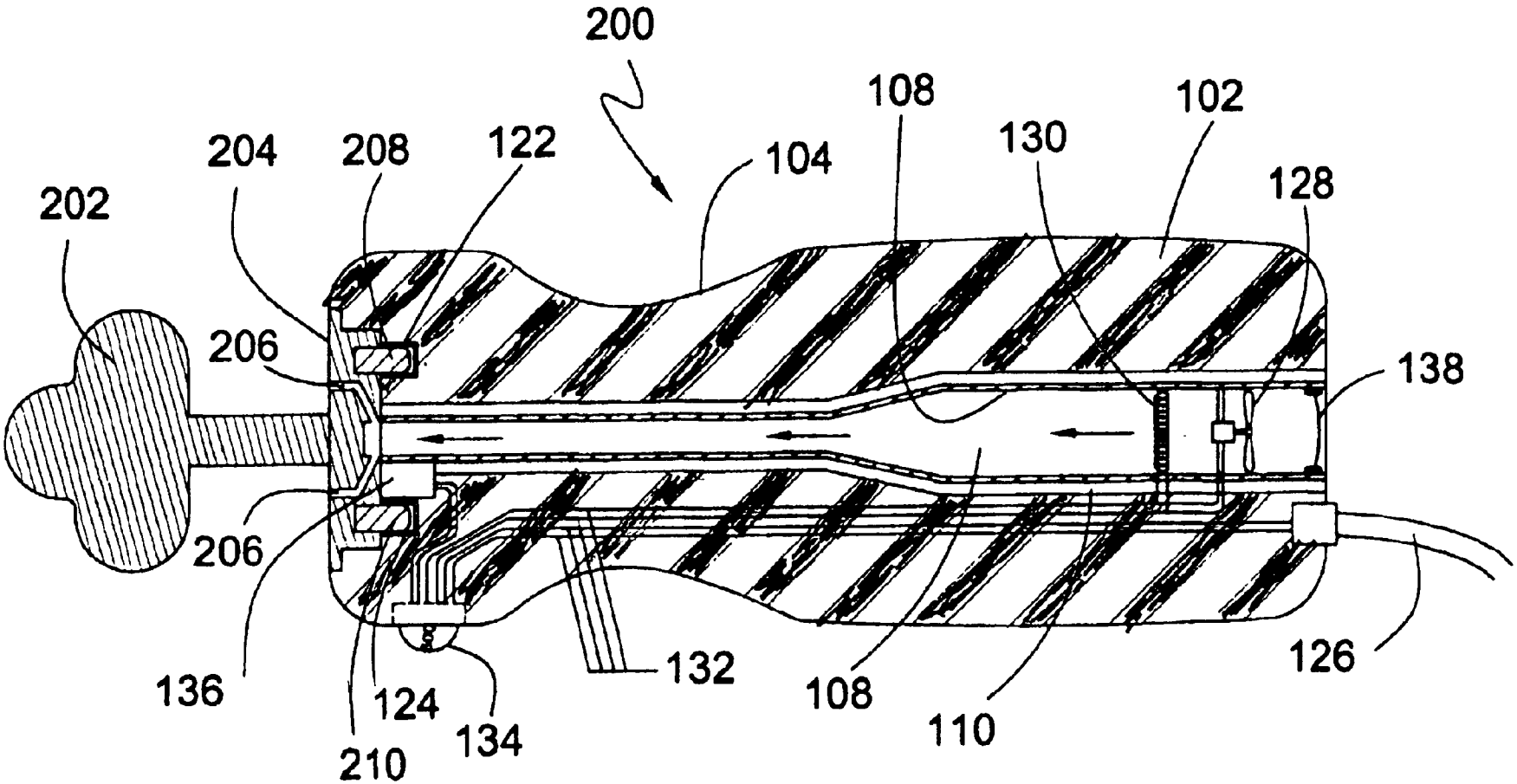
FIG. 15 is a top sectional view of another embodiment using heated air to heat scraper assembly scraper member. The air is discharged through a pair of ports redirecting air from the tube onto the scraper member.

Another alternate embodiment of the tool 200, also using heated air to heat the scraper member 202, accommodates non-looped scraper members 202, as shown in FIG. 15. In this embodiment 200, the docking member 204 omits the diffusing element 114 of the tool 100, blocking the air and rerouting the same through ports 206 that discharge the heated air onto the scraper member 202. This jetted hot air heats the scraper member 202. The docking member 204 has first and second prongs 208,210 for securely docking the docking member 204 in first and second receptacles 122, 124, respectively.

With respect to the above description then, it is to be realized that the optimum material and dimensional relationships for the parts of the Thermo Paint Scraper tool 30, 100, 200, will include variations in size, materials, shape, and form, which will occur to those skilled in the art upon review of the present disclosure. All equivalent relationships to those illustrated in the drawings and described in the specification are intended to be encompassed by the present invention.

What is claimed is:

1. A paint scraping tool adapted to receive electric power from a power source, comprising:

a body having a bay, the bay being in electrical communication with the power source; and a scraper assembly having a scraper member with a scraping edge of thermally conductive metal material, the scraper member being heat conductive and having an electrically insulated interior pocket enclosed by a material which is electrically insulating and thermally conductive and a electrically powered heating element within the interior pocket, said pocket being adjacent said scraping edge for transfer of heat to said scraping edge, the scraper assembly further having a docking member through which electrical contacts for said heating element extend, the docking member being securely and removably received by the body bay, the docking member being in electrical communication with the bay, such that electric power is provided to the heating element, the heat from the heating element being conducted to the scraper member;

a temperature regulator positioned on the body for regulating the temperature of the scraper member including an off position such that electrical power to the docking member is terminated when the regulator is in the off position;

said docking member having a first prong and a second prong and the bay has a first receptacle and a second receptacle, the first prong mating with the first receptacle and the second prong mating with the second receptacle; and said scraper member being in the form of a loop with a straight blade section having the cutting edge, said interior pocket being located in the straight blade section.

2. The tool of claim 1, wherein the docking member is made of thermally insulating material to insulate the bay from heat.

3. The tool of claim 1, wherein the scraper member is heated to approximately 600 degrees Fahrenheit.

4. The tool of claim 1, wherein the tool further comprises alternatable scraper assemblies, each having a different scraper member shape.

* * * * *